US005845913A

United States Patent [19]

Santarsiero

[11] Patent Number: 5,845,913

[45] Date of Patent: Dec. 8, 1998

[54] SKATE WITH ANIMATED FIGURES OR FEATURES

[76] Inventor: Paul Santarsiero, 112 High Ridge Rd., Avon, Conn. 06001

[21] Appl. No.: 805,854

[22] Filed: Mar. 3, 1997

[51] Int. Cl.[6] ..... A63C 17/02

[52] U.S. Cl. ..... 280/11.19; 446/288

[58] Field of Search ..... 280/11.19, 11.27, 280/11.28, 1.13, 1.22; 446/275, 279, 280, 288, 465, 470

[56] References Cited

U.S. PATENT DOCUMENTS

| | | | |
|---|---|---|---|
| D. 162,513 | 3/1951 | Brice . | |
| D. 232,108 | 7/1974 | Krause . | |
| 1,150,440 | 8/1915 | Logan . | |
| 1,560,607 | 11/1925 | Recatti . | |
| 1,589,020 | 6/1926 | Siebenhaar . | |
| 2,168,820 | 8/1939 | Edstrom | 280/11.19 |
| 2,320,560 | 6/1943 | Braddock . | |
| 2,417,157 | 3/1947 | Duvall . | |
| 2,494,681 | 1/1950 | Wisoff . | |
| 3,302,954 | 2/1967 | Elwell . | |
| 3,359,680 | 12/1967 | Lindsay . | |
| 3,407,531 | 10/1968 | Crawford . | |
| 3,462,880 | 8/1969 | Tomaro, Jr. . | |
| 3,698,125 | 10/1972 | Hartling et al. . | |
| 4,019,276 | 4/1977 | Nakao . | |
| 4,043,241 | 8/1977 | Liu . | |
| 4,186,516 | 2/1980 | Ensmann . | |
| 4,298,910 | 11/1981 | Price | 280/11.19 |
| 4,304,417 | 12/1981 | Hsieh | 280/11.19 |
| 4,307,533 | 12/1981 | Sims et al. . | |
| 4,318,242 | 3/1982 | Pin-Houng . | |
| 4,424,978 | 1/1984 | Kassai . | |
| 4,836,819 | 6/1989 | Oishi et al. . | |
| 4,889,514 | 12/1989 | Auer et al. . | |
| 5,334,078 | 8/1994 | Hippely et al. . | |

*Primary Examiner*—Richard M. Camby
*Attorney, Agent, or Firm*—Wolf,Greenfield & Sacks,P.C.

[57] ABSTRACT

A child's roller skate having animated features which move, rotate, or reciprocate. The motion of the animated features is activated by the rotation of the wheels by the child when skating. Through cams, gears, and pulleys, the rotation of the wheels causes feature to change positions.

3 Claims, 17 Drawing Sheets

Fig. 1
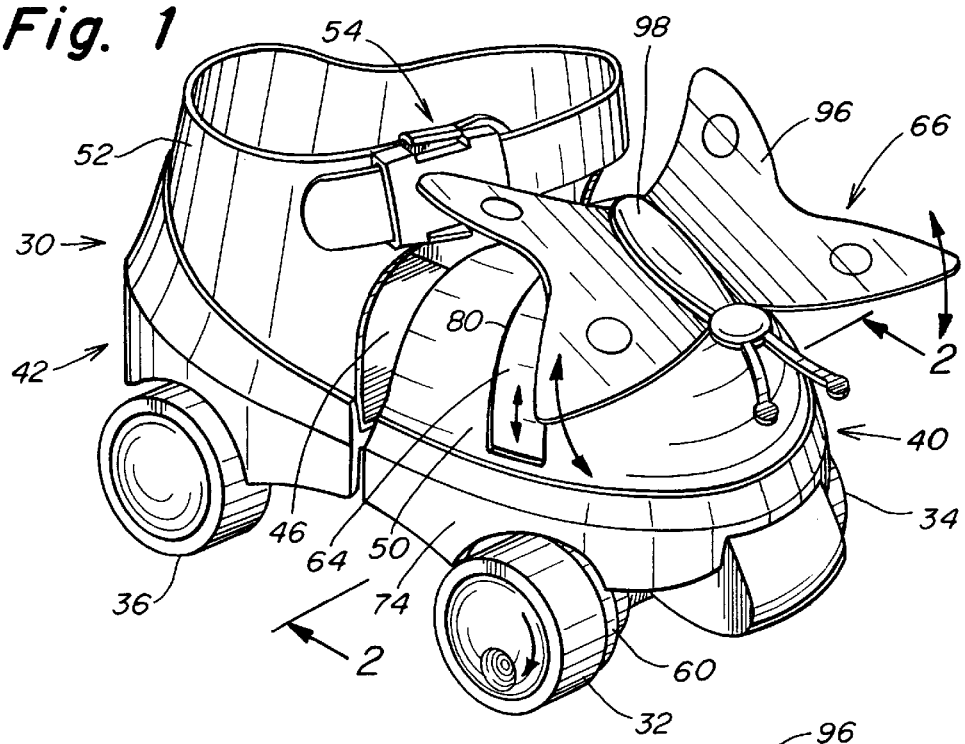
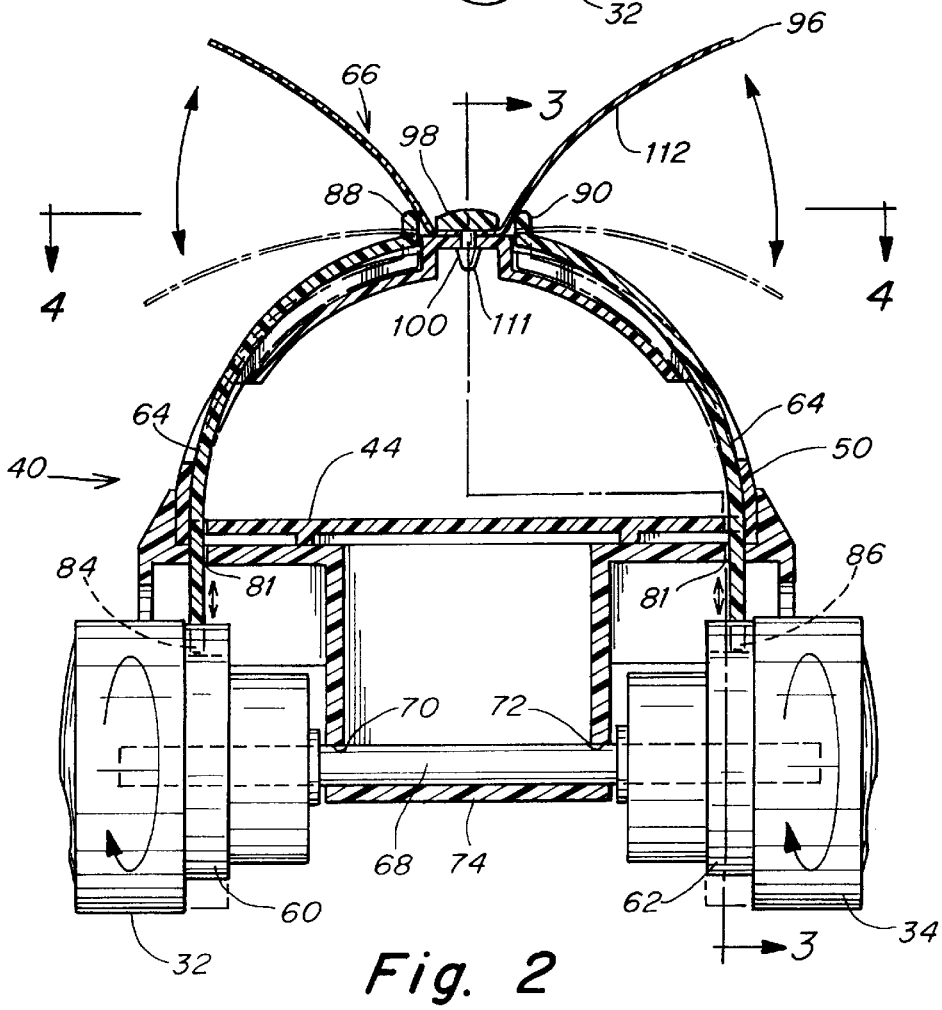
Fig. 2

Fig. 3
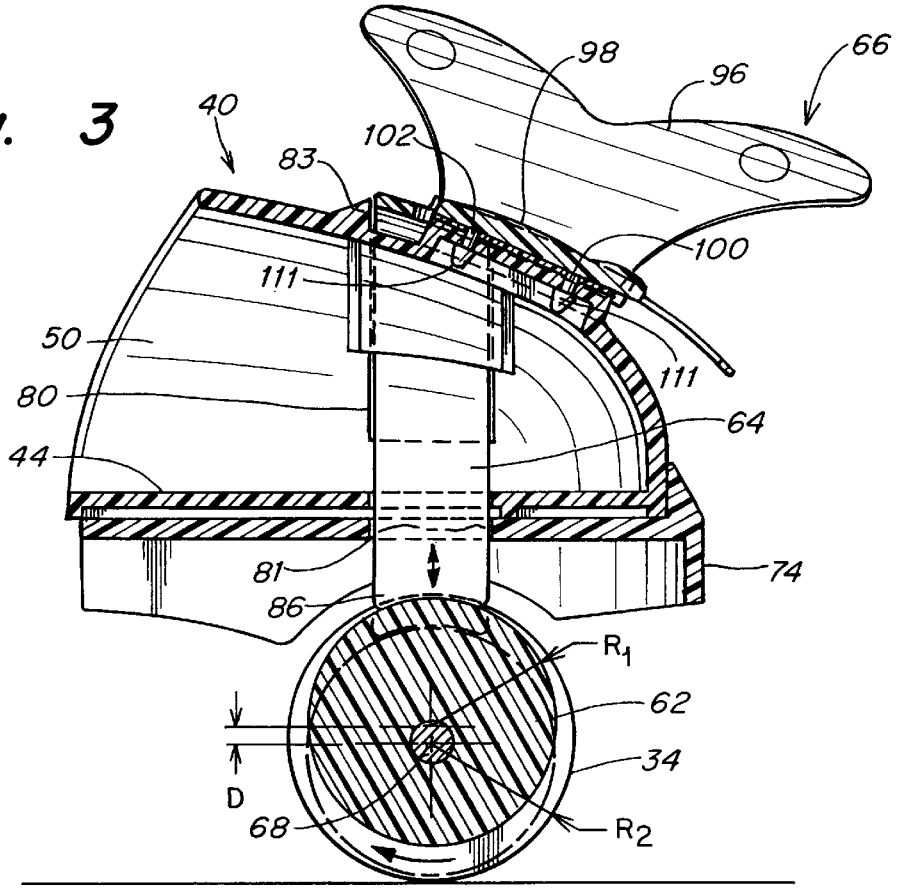
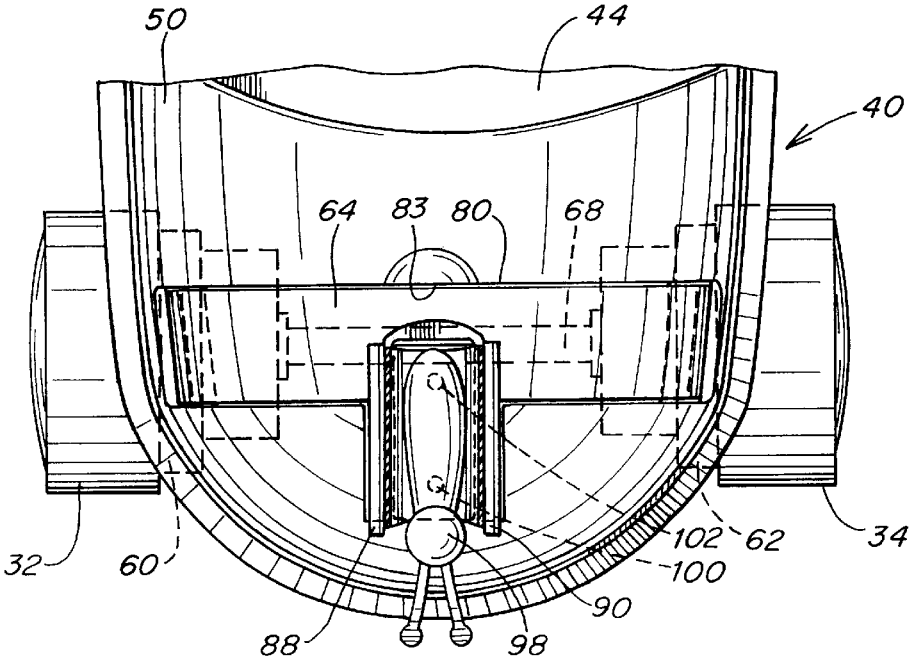
Fig. 4

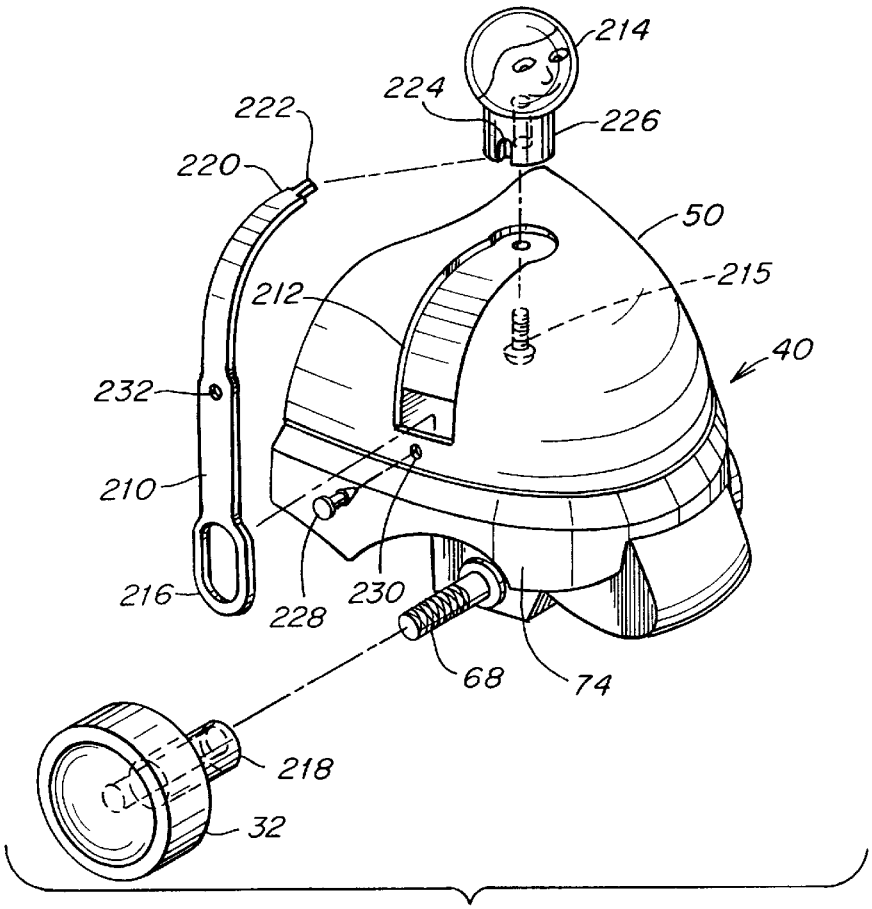
Fig. 14
Fig. 11
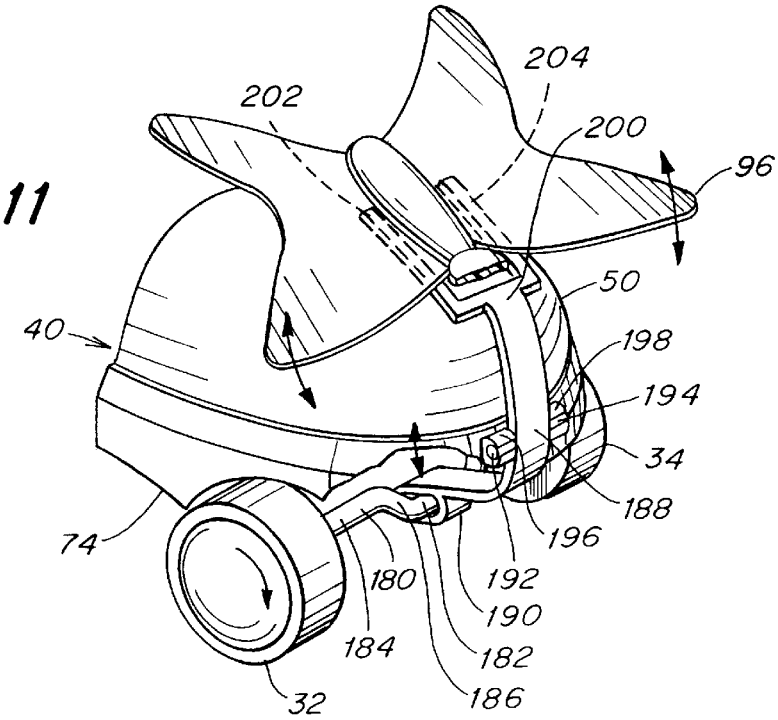

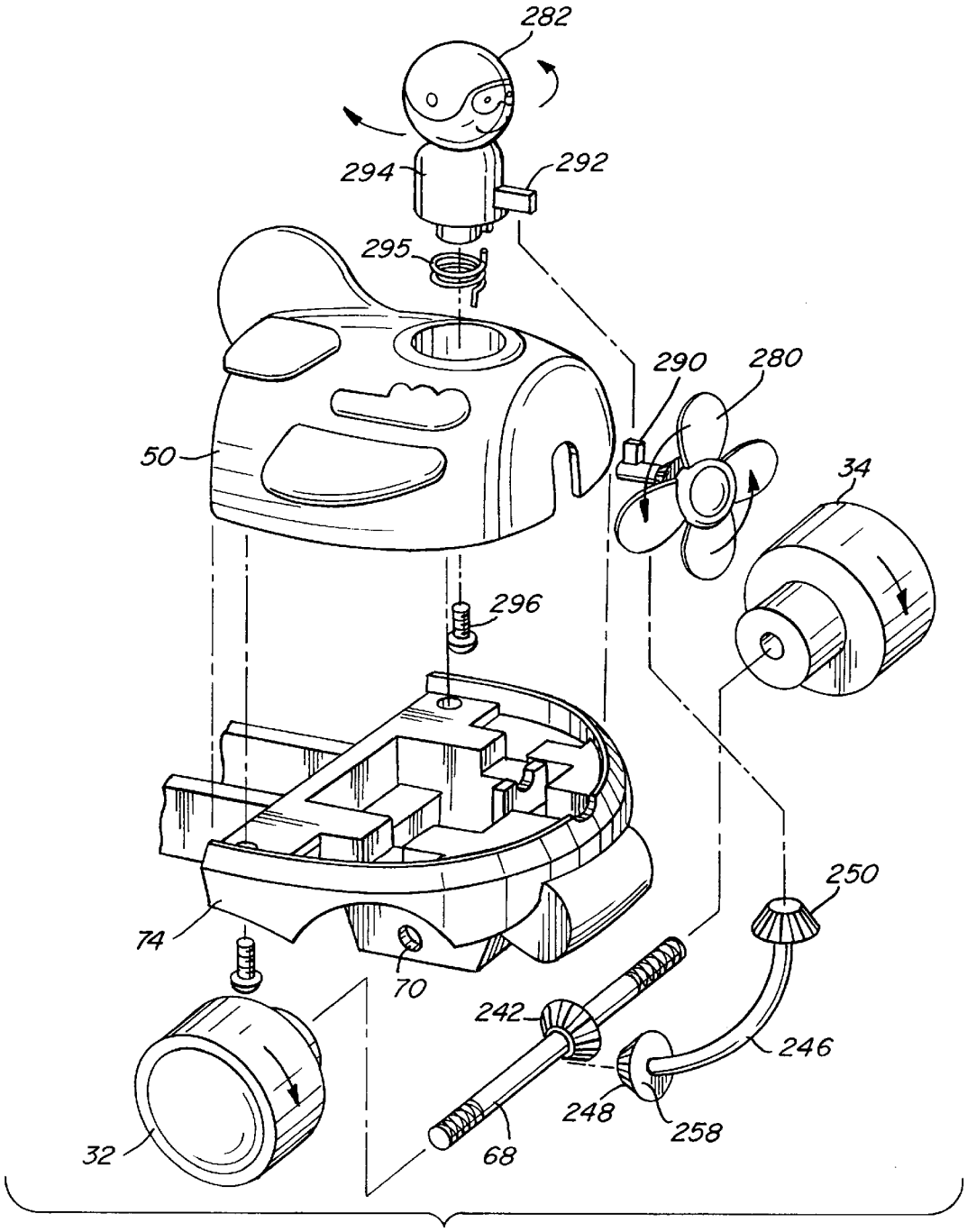
Fig. 17
Fig. 17A
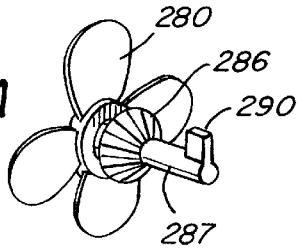

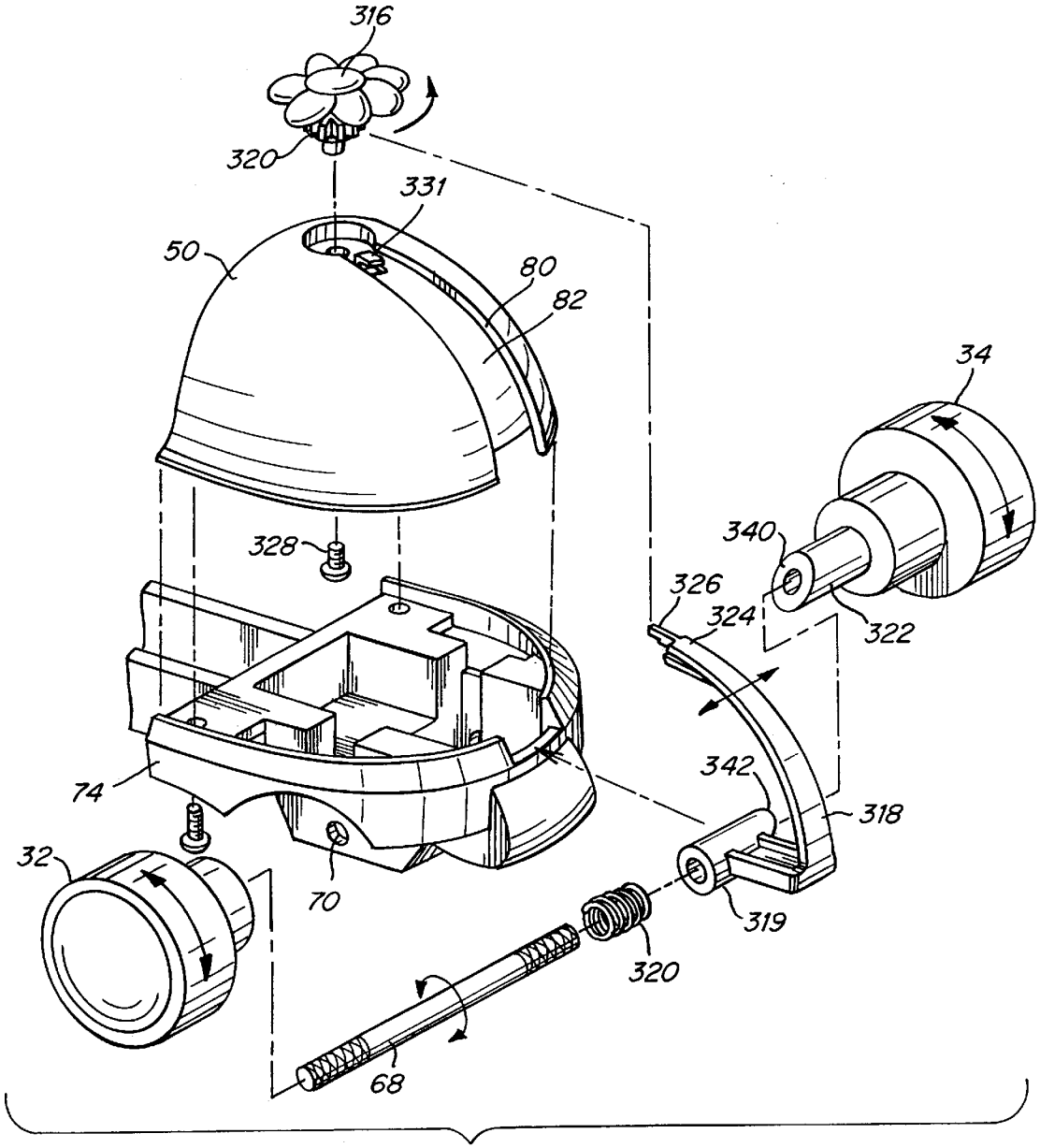
Fig. 22
Fig. 22A
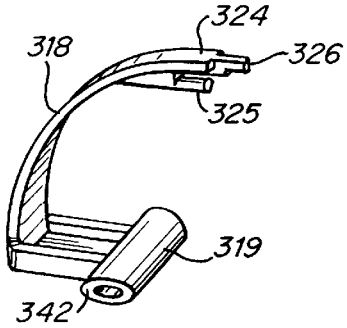

SKATE WITH ANIMATED FIGURES OR FEATURES

BACKGROUND

1. Field the Invention

The present invention relates to roller skates having ornamental designs, and, more particularly, roller skates in which the ornamental designs are figures and/or features which move, rotate, or reciprocate when the skate is in use.

2. Background of the Invention

Roller skating continues to be a very popular sport for young children. The manufacture by several companies of simple, large-wheeled, lightweight skates has allowed very young children to participate. Along with younger and younger children comes the need to develop and design more interesting skates since very young children generally skate at a slow pace. To attract the very young skaters to the marketplace, companies commonly sell their skates in a wide variety of colors and logos. Some skates have decals or pictures of famous cartoon characters while others include popular themes often targeted specifically to boys or girls.

A structural change in the basic skate shape is shown in Krause, U.S. Pat. No. D232,108, issued Jul. 16, 1974, which relates to a roller skate having a chassis in the shape of an automobile. This design includes a plurality of features intended to mimic an automobile such as headlights, a front grille, and fenders. However, based on the teaching of the patent, none of the elements are animated.

SUMMARY OF THE INVENTION

It is an object of the present invention to provide a roller skate having an animated figure or feature.

It is another object of the present invention to provide a roller skate having at least one figure or feature which is animated when the skate is used for its intended purpose.

It is still a further object of the present invention to provide an animated figure or feature on a skate which is simple and inexpensive to manufacture.

The present invention is accomplished by providing a figure or feature on the toe cap which is activated by rotation of the wheels.

These and other objects and features of the present invention will be better understood and appreciated from the following detailed description of several embodiments thereof, selected for the purpose of illustration and shown in the accompanying drawings, in which:

BRIEF DESCRIPTION OF THE DRAWING

FIG. 1 is a perspective view of one embodiment of the present invention;

FIG. 2 is a cross-sectional front view taken along the line 2—2 of FIG. 1;

FIG. 3 is a cross-sectional side view taken along the line 3—3 of FIG. 2;

FIG. 4 is a cross-sectional plan view taken along line 4—4 of FIG. 2;

FIG. 11 is a front perspective view of a fifth embodiment of the present invention;

FIG. 14 is an exploded perspective view of the sixth embodiment;

FIG. 17 is an exploded perspective view of an eighth embodiment of the present invention;

FIG. 17A is a detailed view of the back of the propeller of FIG. 17;

FIG. 22 is an exploded perspective view of an eleventh embodiment of the present invention;

FIG. 22A is a detailed view of an element shown in FIG. 22;

DETAILED DESCRIPTION OF THE PREFERRED EMBODIMENTS

Figure 5:
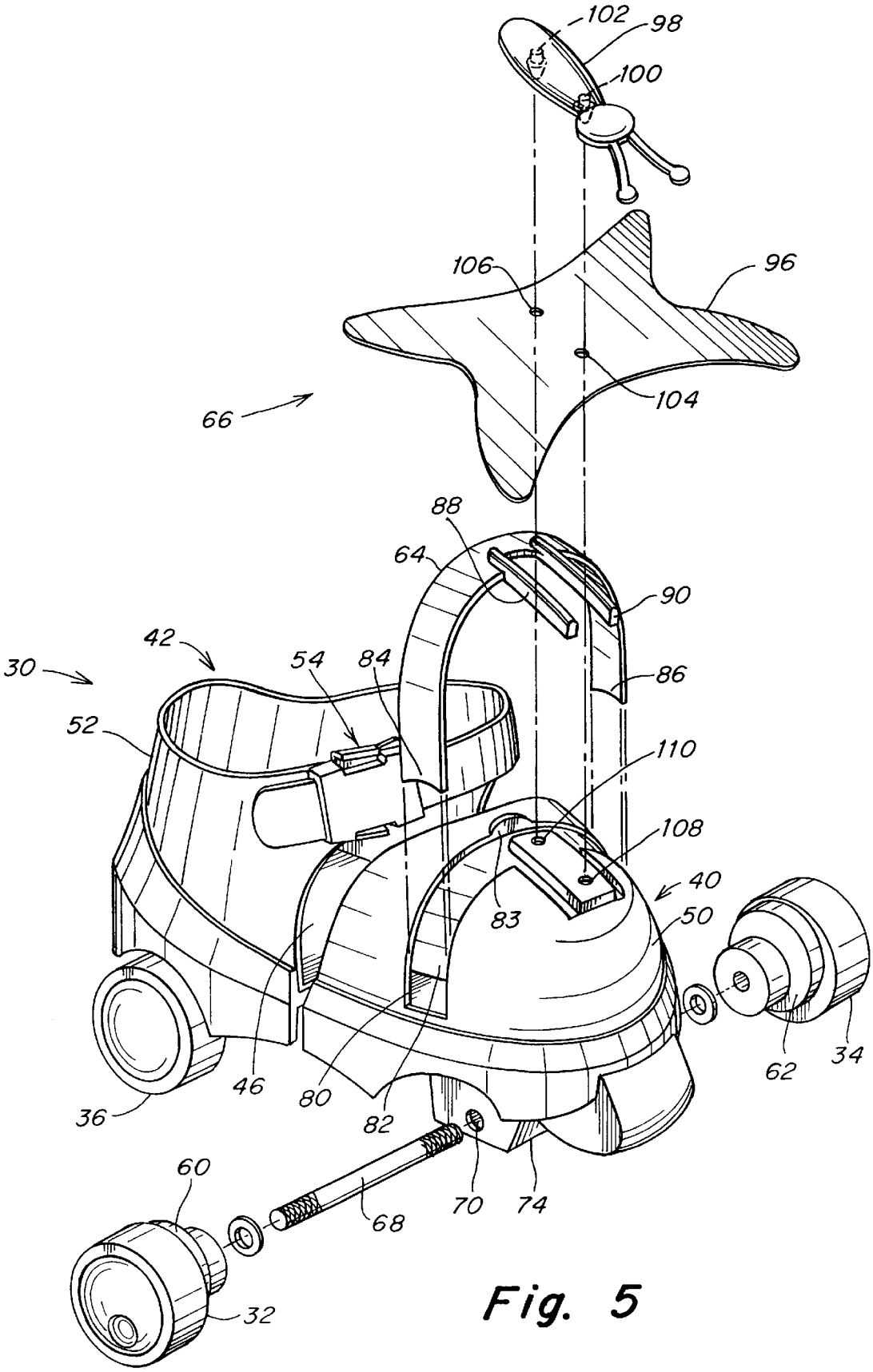
FIG. 5 is an exploded perspective view of the first embodiment.

The present invention generally relates to imparting motion to figures or features on a roller skate. Even though the present embodiments are shown on side by side roller skates, it should be understood that the present embodiments may be readily adapted by one of ordinary skill in the art for use in conjunction with in-line roller skates. In addition, while the embodiments shown include varying figures or features such as butterflies and flowers as will be discussed in more detail below, it is the manner by which the motion is imparted on those features that is the focus of the present invention—not the incidental specific character or feature which is for illustrative purposes only.

The following elements are common to all of the embodiments: a front pair of wheels (which may be equivalently replaced by a single wheel on an in-line roller skate), an object to be animated, and a translational mechanism activated by the rotation of the front wheels which in turn imparts a motion on the object.

Where appropriate, like numbers will be used on like elements in the various embodiments. The skate 30 includes front and rear wheels 32, 34, 36, 38 (not shown). The front wheels 32, 34 are secured to a forward portion 40 of the roller skate 30, and the rear wheels 36, 38 are secured to the back portion 42 of the roller skate 30. Both the forward and back portions 40, 42 include platforms 44, 46 for supporting the child's foot. Mounted to the forward and back portions 40, 42 are a toe cap 50 and heel cup 52, respectively. The heel cup 52 as shown includes a buckle/strap arrangement 54 for securing the child at about the ankle. Finally, the skate 30 as shown is extendible so that the length of the skate 30 may be adjusted according to the size of the child's foot.

FIGS. 1–11 illustrate several embodiments which are further related because an "up and down" motion is imparted on the animated element. The basic feature common to these embodiments is a cam which converts the rotary motion of the wheels 32, 34 into the cyclical linear motion of the animated element.

The first embodiment is illustrated in FIGS. 1–5. In this embodiment, the front wheels 32, 34 include integral cams 60, 62. The translational element is a strut or cam follower 64 having a horseshoe shaped profile as best seen in FIG. 5. Finally, the animated object is a butterfly 66.

The wheels 32, 34 with cams 60, 62 are best seen in FIGS. 3 and 5. In FIG. 3, the solid lines represent the cam 62 in the uppermost position, while the dotted or phantom lines show cam 62 in the lowermost position. The offset distance D of cam 62 is based on the differences between the two radii $R_1$ and $R_2$. The cams 60, 62 are secured to the front axle 68 which in turn passes through openings 70, 72 of the chassis 74.

The strut 64 moves within channel 80 which is formed in the toe cap 50 and an opening 81 (FIG. 6) in the chassis 74. The strut 64 is further maintained in substantially the same plane as the toe cap 50 by means of a bottom support piece 82 and rear flange 83 along the upper portion of the toe cap 50. The strut 64 as shown in FIG. 5 extends upwardly from a position abutting the cams 60, 62 where the ends 84, 86 of the strut 64 are shaped to receive the cams 60, 62. Finally, as best seen in FIG. 5, the strut 64 includes ribs 88, 90 which extend forwardly to engage and animate the butterfly 66 as will be discussed below.

The butterfly 66 of the first embodiment includes a single, two-winged structure 96 and a torso/head configuration 98. The wing structure 96 is preferably a soft vinyl and the torso/head configuration 98 is preferably a hard plastic. The butterfly 66 is fastened to the skate 30 by a pair of projections 100, 102, preferably vinyl, which pass though holes 104, 106 in the wing structure 96 and holes 108, 110 in the toe cap 50. The head portion 111 of the projections 100, 102 are shaped so that they cannot be pulled through the holes 104, 106, 108, 110 once snapped in place.

Operation of the present invention should be obvious based on the structure. When the child skates either forward or backward, the wheel 32, 34 rotate. The cams 60, 62 which are integral with the wheels 32, 34 also rotate. As the cams force the strut 64 upwardly, the ribs 88, 90 in turn impart an upward force on the underside 112 of the wing structure 96 on both sides of the torso configuration 98 thereby creating the impression that the butterfly 66 is fluttering. Therefore, as the cam moves through its cycle, the ribs 88, 90 change the height of the wing structure 96 on both sides of the torso 98. The wing 96 should be manufactured to impart a slight downward force against the ribs 88, 90 to ensure that the wing 96 and ribs 88, 90 are always abutting, even when the ribs 88, 90 are in their lowermost position. It should be understood that the above description relates to cams 60, 62 that cycle in the same pattern. However, it is within the scope of this invention to position the cams 60, 62 so that they rotate out of sync. Thus, if desired, the ribs 88, 90 could simultaneously rise on one side and fall on the other.

Figure 6:
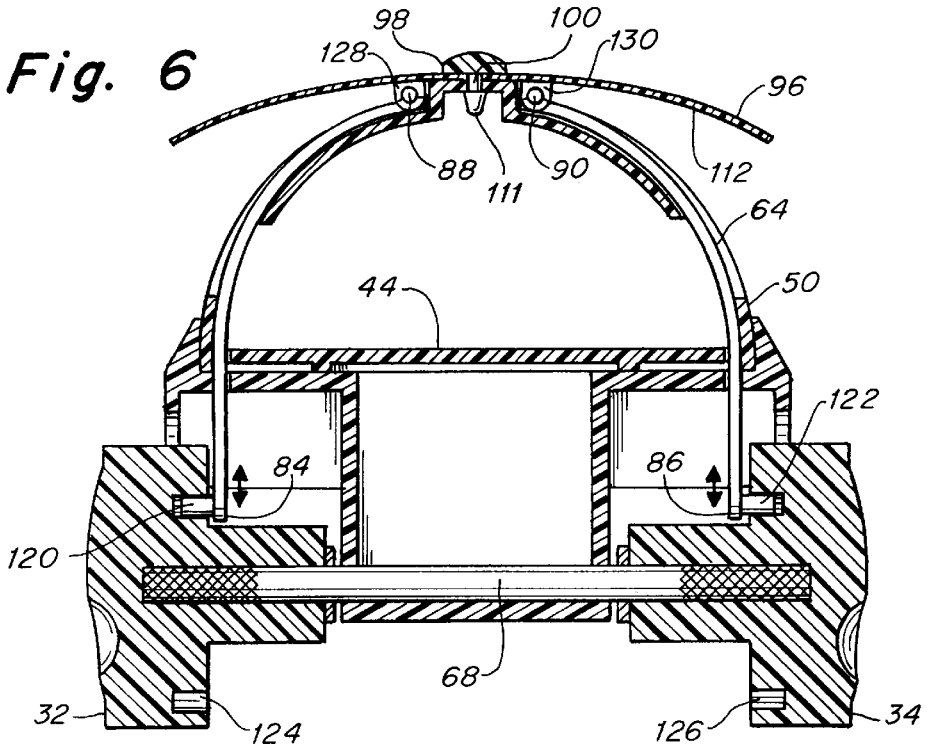
FIG. 6 is a cross-sectional front view of a second embodiment of the present invention.
Figure 7:
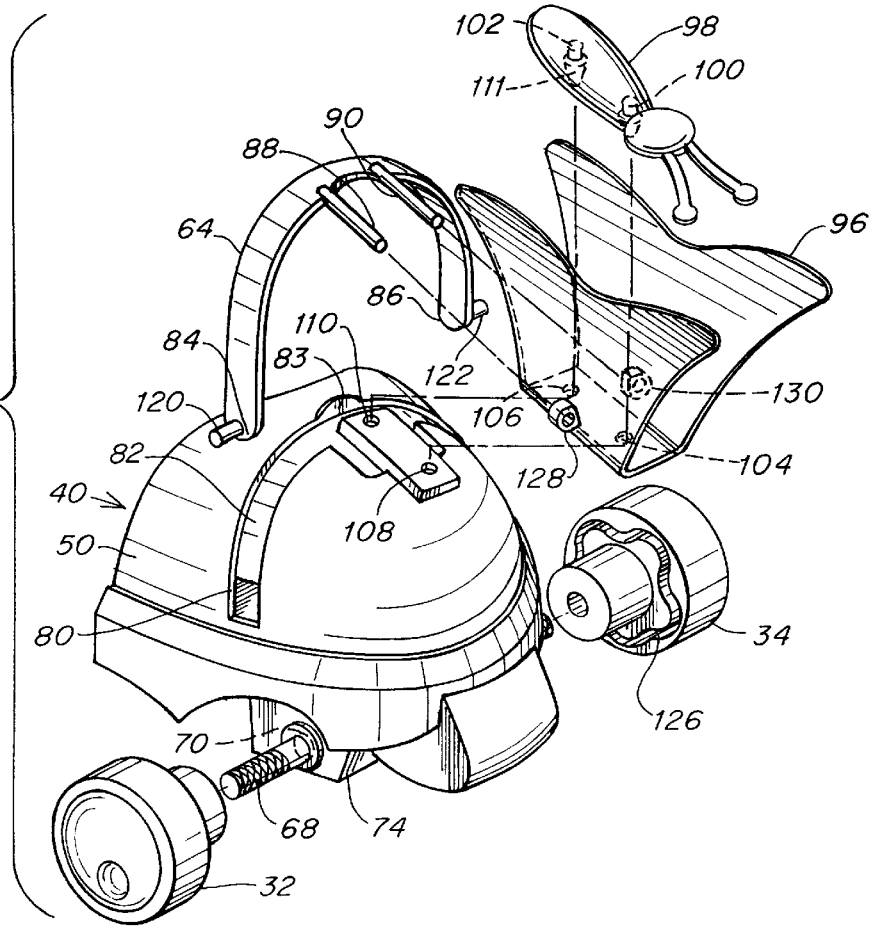
FIG. 7 is an exploded perspective view of the front portion of the skate.

The second embodiment which is illustrated in FIGS. 6 and 7 is similar to the first embodiment except the cam system and butterfly wing structure 96 are somewhat different. In this embodiment, the strut 64 includes posts 120, 122 which travel within wavy slots 124 (not shown), 126 on the wheels 32, 34. Thus, the strut 64 is raised and lowered according to the position of the posts 120, 122 in the slots 124, 126. In the slot pattern shown in FIG. 7, the wings would flutter more rapidly, although this is merely a feature of the pattern selected.

The wing structure 96 of the second embodiment includes channels or receptors 128, 130 though which the ribs 88, 90 pass. This arrangement results in a more pronounced fluttering of the wings, although the effect should be essential the same as in the first embodiment.

As with the various structures that will be discussed, the embodiments are not mutually exclusive such that interchanging systems is within the scope of the invention. For example, the cams 60, 62 of the first embodiment may be readily used in a skate design which includes the rib receptor structure 128, 130 of the second embodiment.

Other cam arrangements are also contemplated for use with this system. For example, based on the second embodiment (FIG. 6), the slot could circumnavigate the inside surface of the wheel in a circular, not wavy, pattern. In this version, the horizontal length of the slot would vary. Another cam embodiment could simply have the inside surface of the wheel sculpted to with varying horizontal lengths to force the strut posts inwardly as desired.

Figure 8:
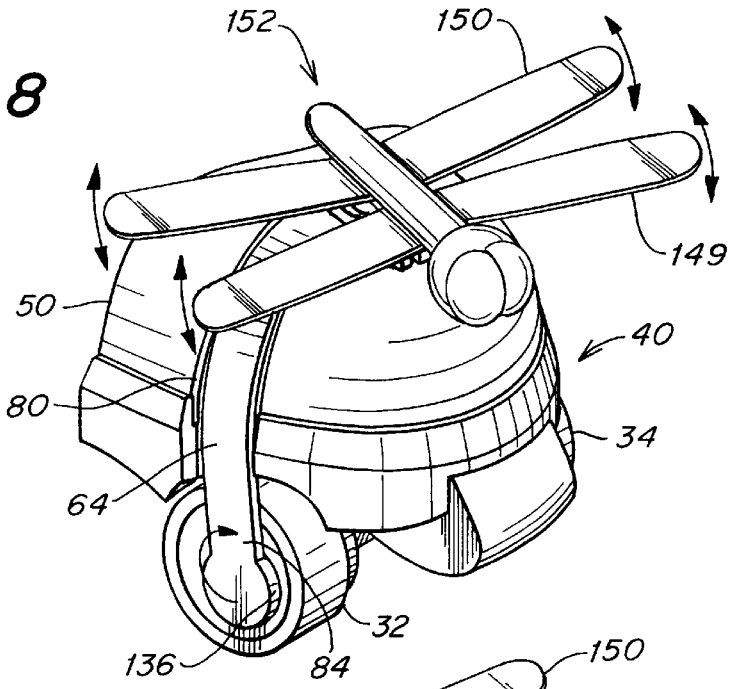
FIG. 8 is a front perspective view of a third embodiment of the present invention.
Figure 9:
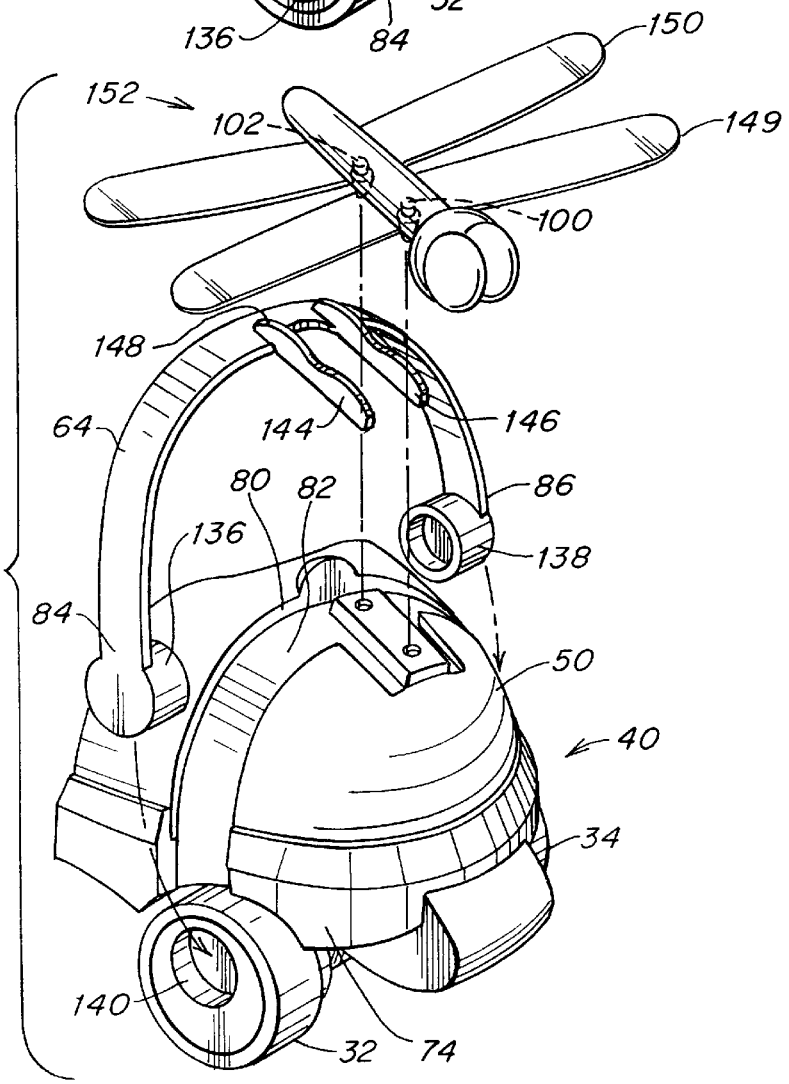
FIG. 9 is an exploded perspective view of the third embodiment.

FIGS. 8 and 9 illustrate a third cam arrangement in which the cam system comprises inwardly extending heads 136, 138 from the ends 84, 86 of the strut 64. The heads 136, 138 are secured both by friction and by the tension created by the arcuate strut 64 within openings 140, 142 (not shown) in the front wheels 32, 34.

The ribs 144, 146 have an uneven top edge 148 to impart a flapping motion alternately between the front 149 and back wings 150 of the dragonfly 152. Moreover, in this embodiment, the heads 112 of the projections 100, 102 are frictionally secured with the holes 108, 110 (FIG. 7) so that the strut 64 (with ribs 144, 146) and dragonfly 152 may be readily removed to be replaced with different action figures with a flapping element.

Figure 10:
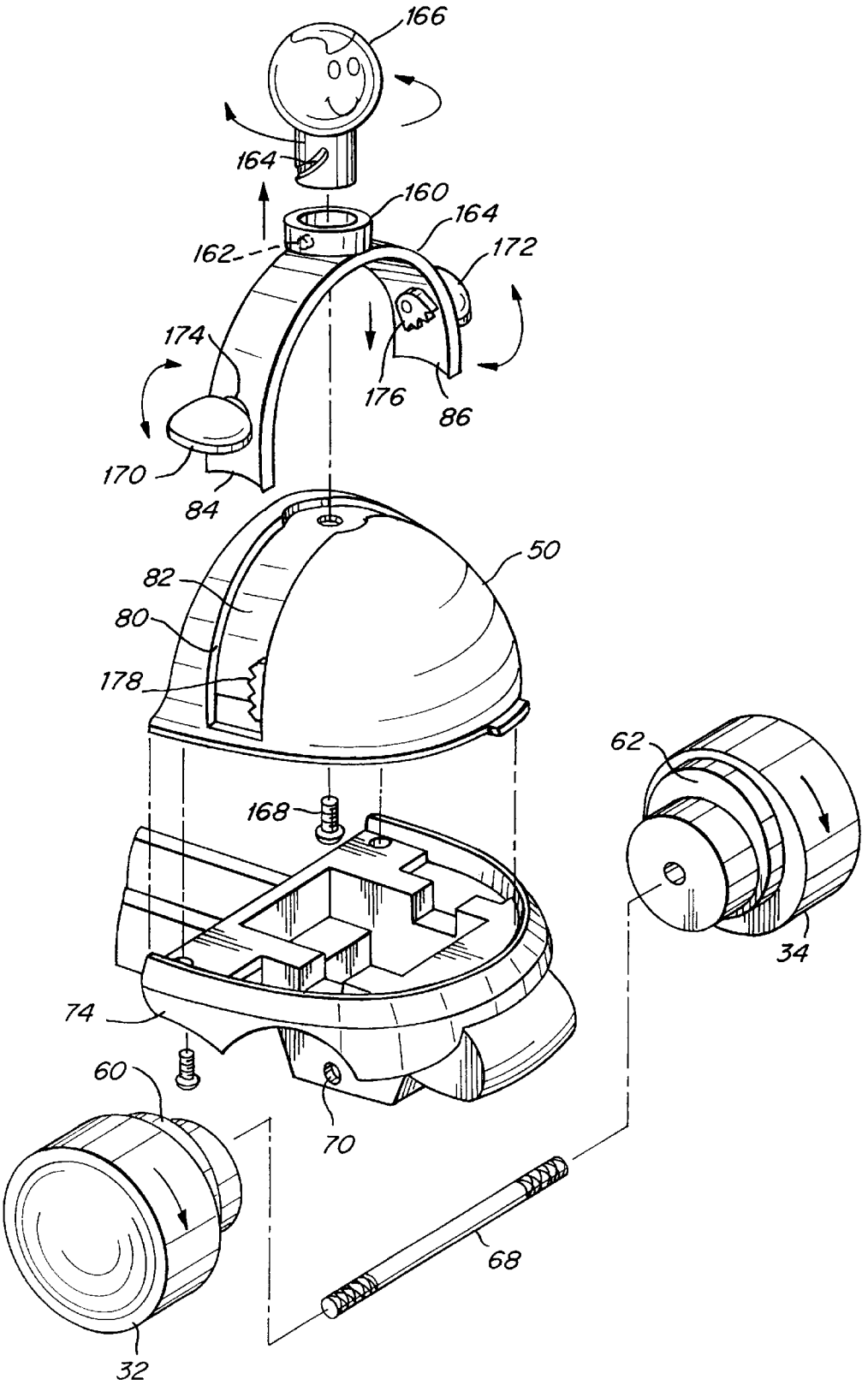
FIG. 10 is an exploded perspective view of a fourth embodiment of the present invention.

In FIG. 10, the strut 64 has a collar 160 which includes an inwardly extending post 162 shown in phantom. The post 162 is shaped to engage a curved groove 164 on the neck of an animated head 166 which pivots within the collar 160 on a screw 168. A pair of feet 170, 172 pass though the strut 64 proximal to the ends 84, 86. The feet 170, 172 include stems 174 having a toothed end 176 which mates with a corresponding rack gear 178 molded to the toe cap 50 in a location hidden by the strut 64. As the strut 64 moves up and down, the feet 170, 172 also move up and down while simultaneously rotating alternately clockwise and counter-clockwise.

In the embodiment of FIG. 11, the offset feature of the cam arrangement is incorporated into the axle 180. Instead of the straight axle 68 of the previous embodiments, this axle 180 includes a center section 182 which runs parallel to the wheel engaging end sections 184. A perpendicular length 186 extends between the center and end sections 182, 184.

A strut or cam follower 188 is secured to the center section 182 by an elongated yoke 190. The strut 188 extends from the center section 182 up and over the toe cap 50 with a profile which generally mimics the forward portion 40 of the skate 30. The strut 188 includes a pair of integral posts 192, 194 which are secured within pivot channels 196, 198 located on the chassis 74. Finally, the strut 188 is forked along its upper end 200 to form a pair of ribs 202, 204 disposed below the wing 96 of the butterfly 66.

As illustrated by the movement arrows, rotation of the wheels 32, 34 in turn rotates the center section 182 of the axle 180. As the center section 182 rotates, the strut 187 generally moves in a vertical plane at the yoke 190 and ribs 202, 204 and pivots at the posts 192, 194. The up and down movement of the ribs 202, 204 causes the wing 96 to flutter.

Figure 12:
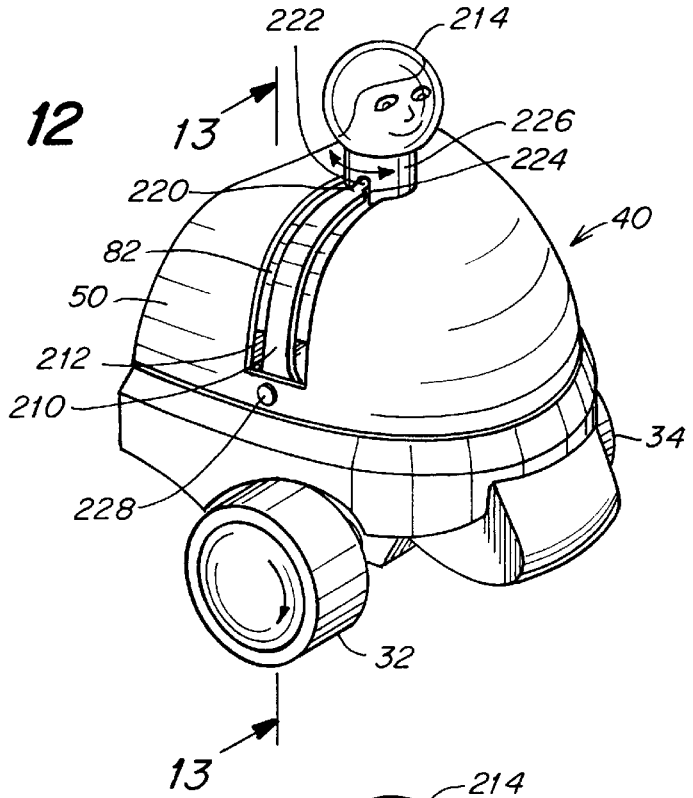
FIG. 12 is a front perspective view of a sixth embodiment of the present invention.
Figure 13:
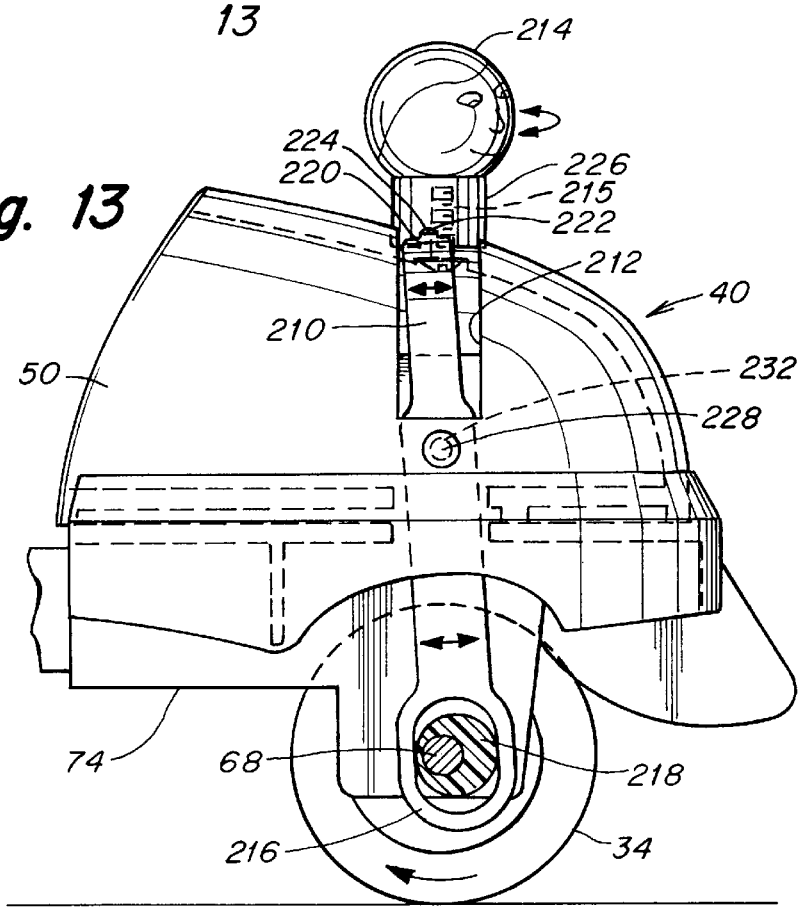
FIG. 13 is a fragmentary cross-sectional side view taken along line 13—13 of FIG. 12.

In the sixth embodiment which is illustrated in FIGS. 12–14, a strut 210 which is positioned within a channel 212 formed in the toe cap 50 rotates a head FIG. 214 from side to side on a pivot screw 215 which secures the head 214 to the toe cap 50. The strut 210, similar to the strut 64 of the first embodiment, extends from the inside of the toe cap 50. However, in this arrangement, the strut 210 is mounted by an elongated yoke section 216 to a cam 218 located on the inside of the wheel 32. The opposite end 220 of the strut 210 includes a tooth projection 222 which is substantially disposed within a socket 224 in the neck 226 of the head 214. Finally, the strut 210 is secured to the toe cap 50 by a pivot pin 228 which passes through a hole 230 in the toe cap 50 and a hole 232 in the strut 210.

As the wheel 32 rotates, the cam 218 causes the strut 210 to move back and forth longitudinally relative to the skate 30. As best seen in FIG. 13, when the yoke 216 is moved rearwardly, strut 210 pivots at 232 and the tooth 222 moves forwardly. The tooth 222 rotates the head 214 on the pivot screw 215. The extent to which the head 214 rotates in based on several factors including the width of the channel 212 which must be larger than the width of the strut 210, the diameter of the wheel 32 and cam 218, and the height of the pivot pin 228. All permutations of these factors are considered within the scope of the invention.

Figure 15:
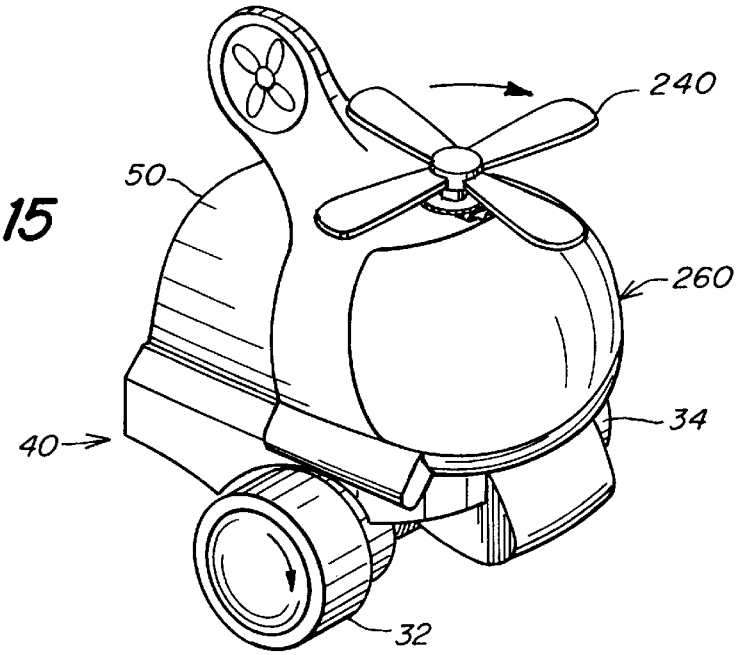
FIG. 15 is a front perspective view of a seventh embodiment of the present invention.
Figure 16:
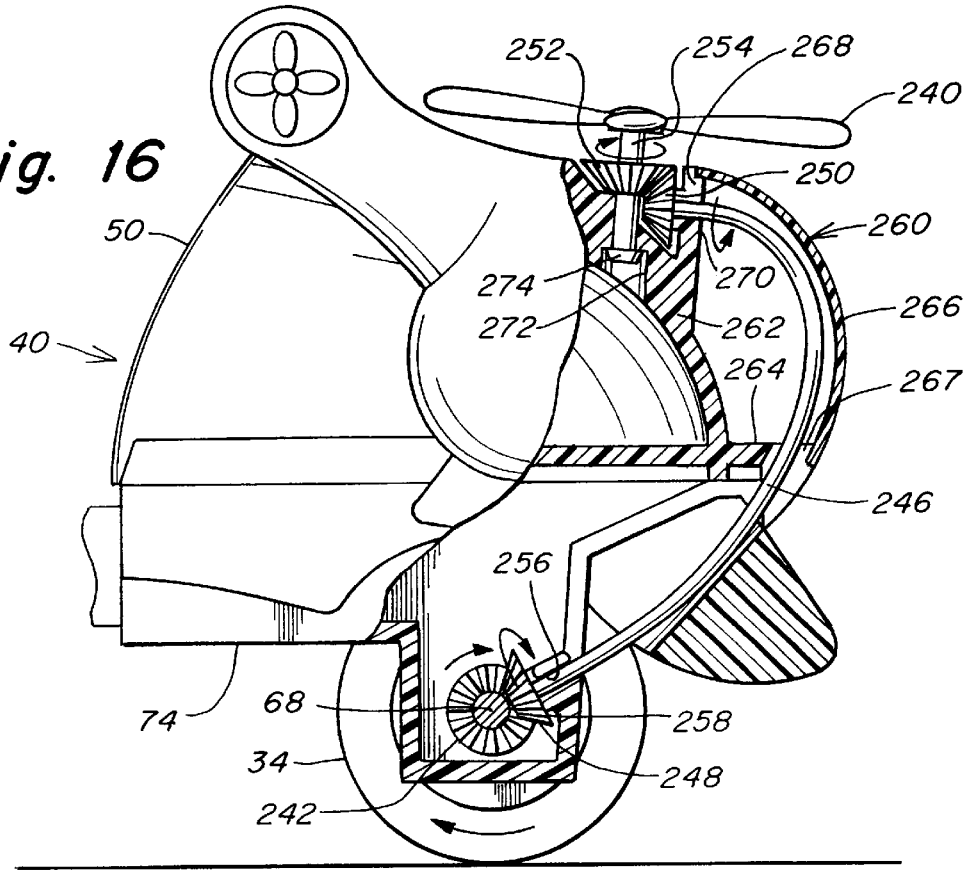
FIG. 16 is a partially broken away side view of the seventh embodiment.

FIGS. 15 and 16 illustrate an embodiment of the present invention in which a rotatable helicopter blade 240 is actuated by movement of the wheels 32, 34. This embodiment does not include cams, but rather a beveled gear 242 which is secured generally in the center of the front axle 68. Disposed in mating alignment with the axle gear 242 is a flexible shaft 246 which has beveled gears 248, 250 at either end. The lower shaft gear 248 engages the axle gear 242 and the second shaft 250 engages a mating gear 252 on the helicopter blade post 254.

The chassis 74 in this embodiment includes a collared opening 256 proximal to the center of the front axle 68. The diameter of the opening 256 is smaller than the diameter of the base 258 of the lower shaft gear 248. This arrangement maintains the gears 242, 248 in mating alignment.

A housing 260, secured to the front face of the toe cap 50, outwardly resembles a helicopter cockpit (FIG. 15). The housing 260 includes a rear wall 262, a bottom wall 264, and a forward wall 266 which extends from the bottom wall 264 in an arc where it joins the rear wall 262. Openings 267, 268 in the lower and rear walls 264, 262 permit the shaft 246 to extend from a location proximal to the axle gear 242 up and through the housing 260 into a position for secured engagement with the post gear 252. The upper opening 268 includes a flange 270 to prevent the upper shaft gear 250 from slipping out of position. Finally, the rear wall 262 includes a collared channel 272 in which a stop 274 of the post 254 is trapped.

The embodiment of FIG. 17 accomplishes rotation of a propeller 280 and pivoting of a pilot 282 generally based on the gear system of the previous embodiment. However, in this arrangement, the flexible shaft 246 extends within the chassis 74 to a position so that the upper shaft gear 250 lies in a horizontal plane where it engages a beveled gear 286 on the propeller post 287 (FIG. 17A).

The movement of the pilot 282 is caused by a cog 290 which extends outwardly from the propeller post 287. The cog 290 is positioned to engage a flange 292 extending from the base 294 of the pilot 282. When the cog 290 reaches the flange 292, the pilot 282 pivots on pivot screw 294. A spring 294 returns the pilot 282 to its originally facing direction after the cog 290 and flange 295 disengage.

In both embodiments shown in FIGS. 15–17A, the shaft 246 is preferably a flexible plastic such that rotation of the lower end gear 248 is at the same rate as the upper and gear 250. Other materials, however, are known to those of skill in the art. An alternative to this arrangement would be to replace the shaft 246 with at least one or a plurality of straight, rigid shafts in series to impart the same motion on the post gear 252. Similarly, the propellers 240, 280 are preferably vinyl, although other materials are also available.

Figure 18:
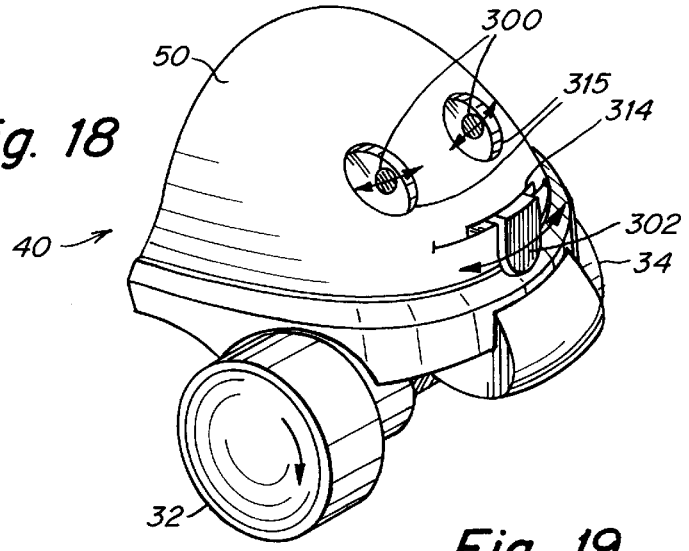
FIG. 18 is a front perspective view of a ninth embodiment of the present invention.
Figure 19:
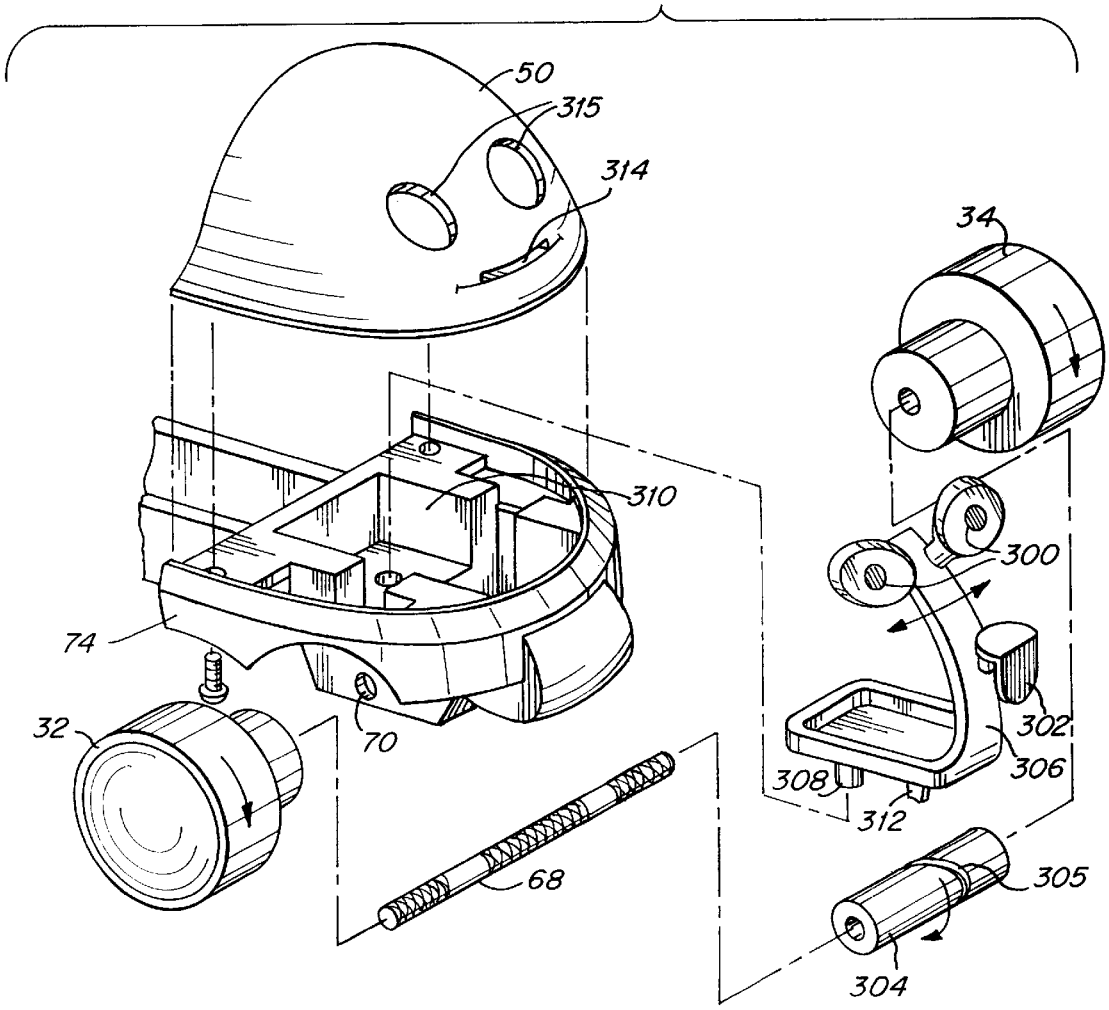
FIG. 19 is an exploded perspective view of the ninth embodiment.

The horizontal movement of the eyes 300 and tongue 302 of the embodiment shown in FIGS. 18 and 19 is accomplished by the use of a sleeve 304 having a spiral groove 305 which is secured to and rotates with the axle 68. A strut 306 is disposed within the chassis 74 by a downwardly extending projection 308 which secures the strut 306 in a opening 310 in the chassis 74. A post 312 also extending downwardly from the strut 306 rides in the groove 305 back and forth across the length of the sleeve 304. If the post 312 size and width of the groove 305, are created with a low tolerance, projection 308 may not be necessary.

The horizontal movement of the post 312 causes the strut 306 also to move transversely. Thus, the tongue 302 which passes through a slot 314 in the toe cap 50, and the eyes 300, which are visible through holes 315 in the toe cap 50, shift from side to side.

The embodiments shown in FIGS. 20–22A illustrate two structures for rotating a figure, the flower 316, on the toe cap 50. Here, a bracket 318 is slidably secured by a sleeve section 319 on the axle 68 within the chassis 74. Also on the chassis 74 are a spring 320, disposed between the wheel 32 and the bracket 318, and a bushing 322 (FIG. 20 embodiment) between the other wheel 34 and the bracket 318. In the preferred version of this embodiment, the bushing 322 is molded to the wheel 34 as a single piece, although it is within the scope of this invention that the bushing 322 be rotationally secured directly to the axle 68 along the knurled surface 323.

The upper end 324 of the bracket 318 has a narrow tab 326 which extends rearwardly on the skate 30. A lower arm 325 extends below and parallel to the upper end 324 (FIGS. 21B, 21D). As best seen in FIGS. 21C and 21E, the lower arm 325 has a tilted D-shaped cross-section.

The flower 316 is attached to a post 327 which is rotatably secured in opening 329 (FIG. 21A) in the toe cap 50 on screw 328. Also disposed on the post 327 are a plurality of rachet-type teeth 330 spaced below the flower 316 (FIGS. 21B, 21D). These teeth 330 are shaped and sized to receive the tab 326.

In the channel 80 of the toe cap 50, a guide 331 extends upwardly from the inner support 82 with a generally inverted L-shaped cross-section, having a wall 332 and platform 333. The platform 333 is slightly slanted (FIGS. 21C, 21E) for reasons that will be discussed in more detail below.

Figure 20:
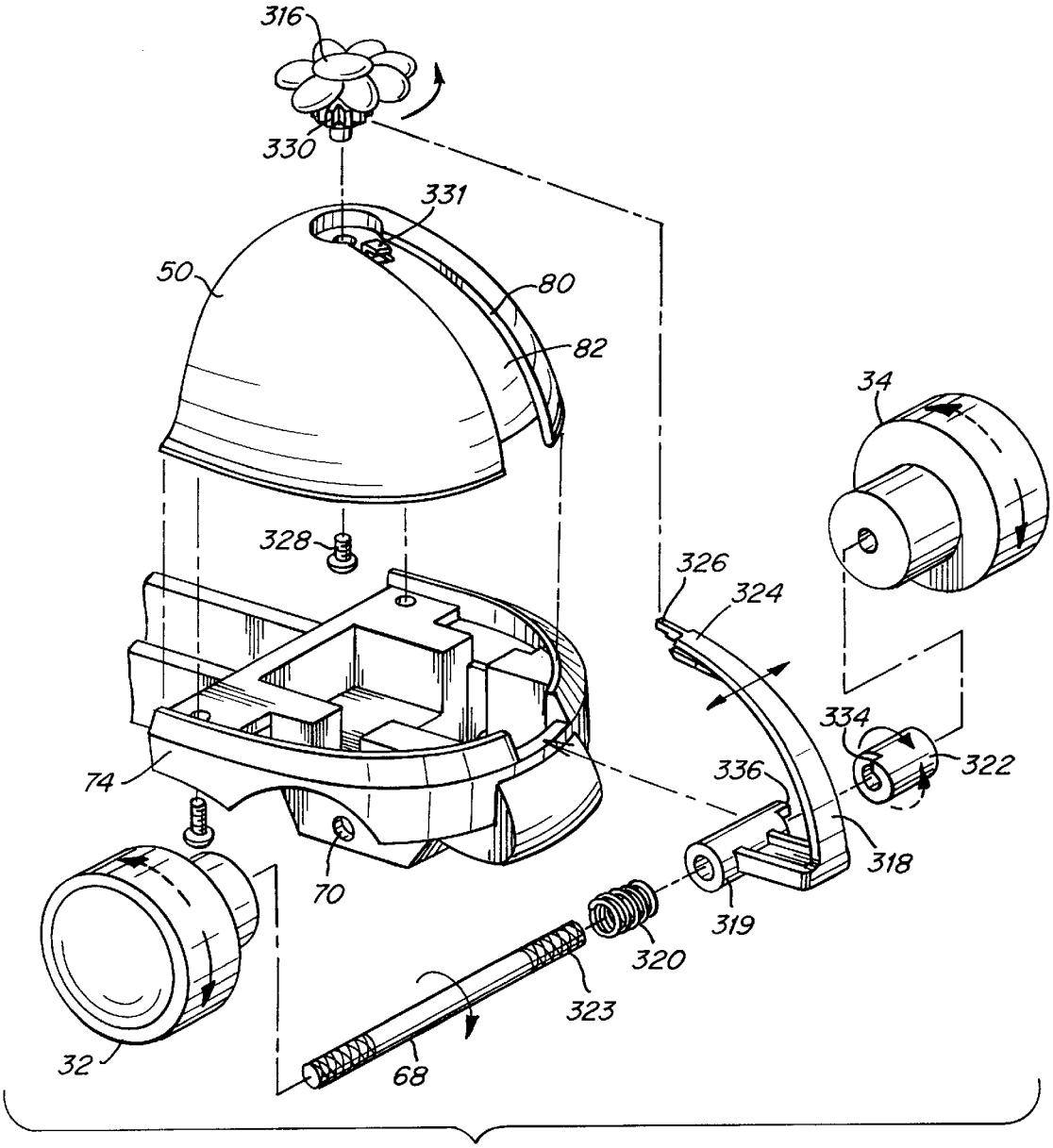
FIG. 20 is an exploded perspective view of a tenth embodiment of the present invention.
Figure 21:
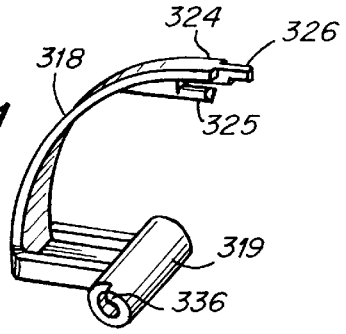
FIG. 21 is a detailed view of an element shown in FIG. 20.
Figure 21A:
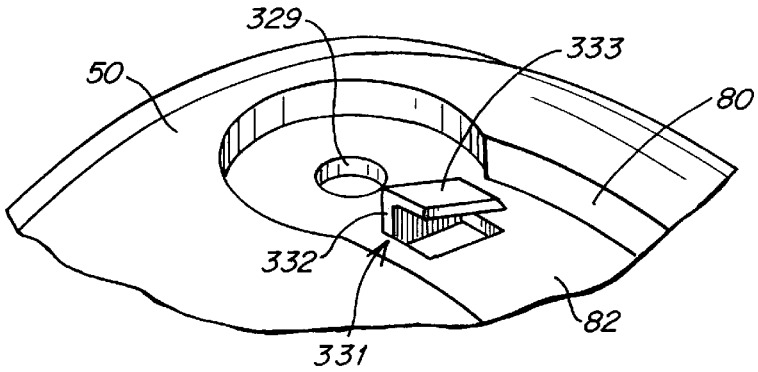
FIG. 21A is a detailed view of an element shown in FIG. 20.
Figure 21B:
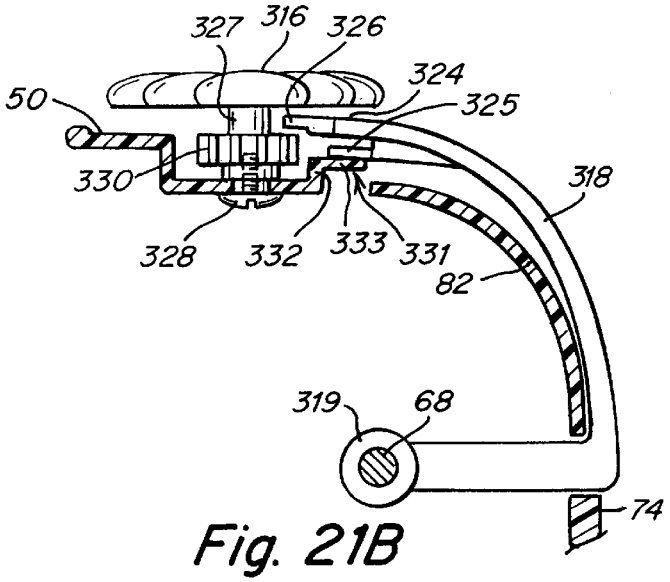
FIG. 21B is a cross-sectional partial view of the tenth embodiment during operation.
Figure 21C:
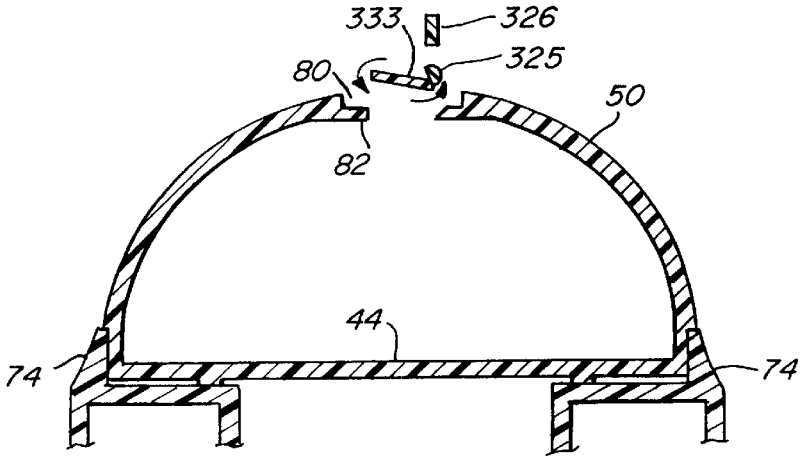
FIG. 21C is a cross-sectional partial view taken at about the same time as FIG. 21B.
Figure 21D:
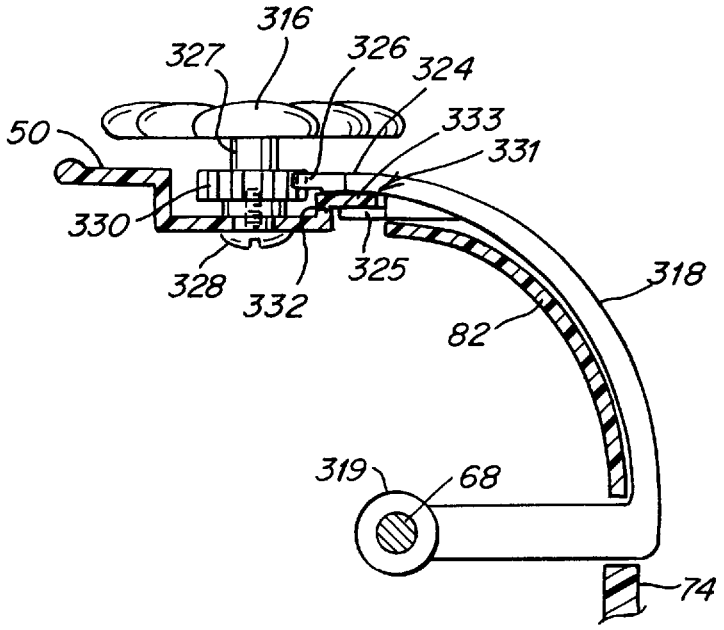
FIG. 21D is a cross-sectional partial view taken at a time after FIG. 21B.
Figure 21E:
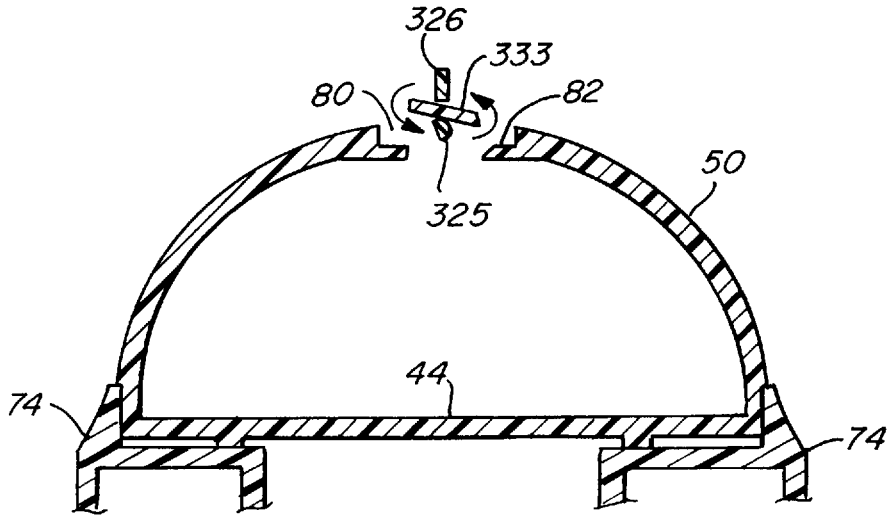
FIG. 21E is a cross-sectional partial view taken at about the same time as FIG. 21D.

In FIGS. 20 and 21, the bushing 322 and the bracket 318 each have aligned mating tooth ends 334, 336. The tooths 334, 336 extend outwardly approximately 2 mm from the respective bushing 322 and bracket 318. This arrangement prevents the front wheels 32, 34 from rolling backward which is often desired in children skates.

When the wheels 32, 34 rotate forward, the bushing tooth 334 rotates and pushes the bracket 318 to the left against the spring 320 as shown in FIG. 20. When the bracket 318 is in the rightmost position, the tooth ends 334, 336 are completely interlocked and the tab 326 is not touching the flower teeth 330. As the bracket 318 moves to the left (FIGS. 21B, 21C) and meets the platform 333, the tilted D-shaped lower arm 325 causes the lower arm 325 to travel on top of the platform 333. Thus, throughout the journey to the left (FIG. 21C), the tab 326 passes between the teeth 330 and flower 316 (FIG. 21B). As long as the lower arm 325 rides on top of the platform, the tab 326 and the teeth 330 do not engage.

When the bracket 318 reaches the leftmost position, the tips of the tooth ends 334, 336 abut, which forces the slidable bracket 318 against the spring 320, and the lower arm 325 is perched on the edge of the high end of the slanted platform 333. In the next moment, the tips of the tooth ends 334, 336 disengage as the spring 320 urges the bracket 318 back to the right, and the lower arm 325 leaves the top of the platform 333 and drops below. On the return, the tab 326 strikes one of the teeth 330 (FIGS. 21D, 21E). Depending on the strength of the spring 320, the action should create a click noise when the tooth ends 334, 336 reengage. The process repeats as long as the wheels 32, 34 are rotating.

It may be necessary to manufacture the bracket 318 with the upper end 324 and lower arm 325 extending rearwardly are slightly different angles. In the present design, the combination of the force of the spring 320 and the cross-section shape of the lower arm 324 causes the upper end 325 to ride on top of the platform 333 while the lower arm 324 is below. However, another manner to ensure that the upper end 324 rides on top of the platform 333 is to have the upper end 324 and lower arm 325 extend at slightly different angles. Thus, when the lower arm 325 falls off the upper edge of the platform 333 which also pulls the upper end 325 downwardly, the upper end 325 would still be directly above the platform 333 and therefore would engage the top of the platform 333 on the way down.

The present design provides that the teeth 330 and tab 326 only engage when the bracket moves left to right. If one were to simply remove the guide 331, the flower 316 would quickly rotate both ways, unlike the continuous counter-clockwise motion of the embodiment described in detail.

FIGS. 22 and 22A illustrate an embodiment similar the previous design, except in this version the roller skate 30 is not prevented from rolling backwards. Instead of the tooth ends 334, 336, the bracket 318 (FIG. 22A) has facing beveled edges 340, 342 which have an angle of approximately 45°. Without an interlock, the same amount of skating force is required to move the bracket 318 either forward or backward. In this embodiment, the tab 324 must be able to clear the teeth 330 on both sides of the flower 316.

Figure 23:
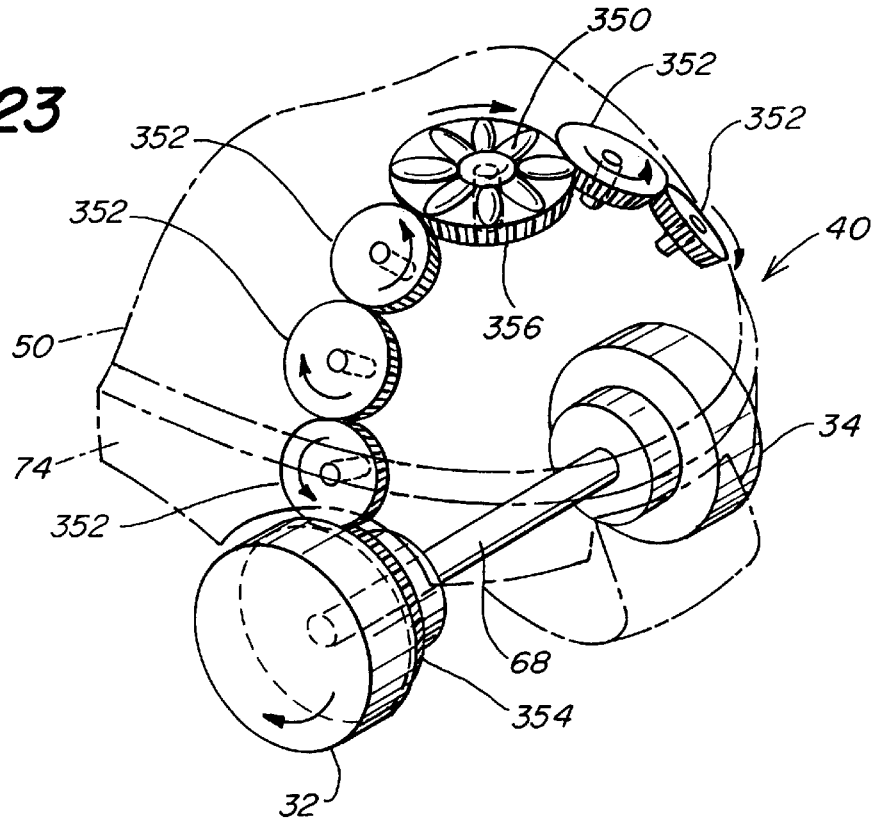
FIG. 23 is a schematic perspective view of a twelfth embodiment of the present invention.
Figure 24:
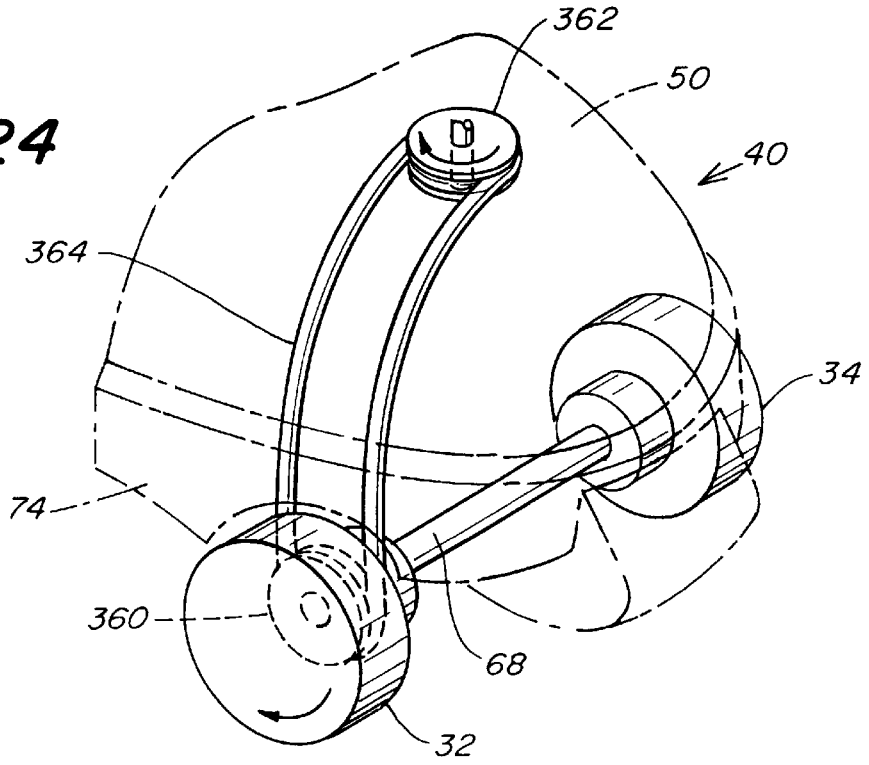
FIG. 24 is a schematic perspective view of a thirteenth embodiment of the present invention.

Other embodiments to rotate a flower 350 are shown in FIGS. 23 and 24.

In FIG. 23, a plurality of gears 352 are arranged in series extending from a wheel gear 354 proximal to the wheel 32 to a gear 356 on which the flower 350 is rotatably mounted. The toe cap 50 is drawn in phantom lines.

The embodiment of FIG. 24 includes a pair of pulley 360, 362 located adjacent to the wheel 32 and on top of the toe cap 50. A figure or feature for rotating is not shown but would be secured to the upper pulley 362. The belt 364 which loops over the pulleys 360, 362 may be made of string, rubber, vinyl, injection molded, polyethylene, or nylon. In addition, the belt 364 may be formed of individual linked sections or beads in which case the pulleys 360, 362 may have recesses to receive the beads.

Figure 25:
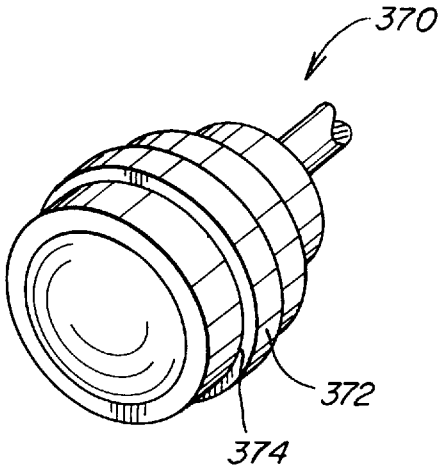
FIG. 25 is a perspective view of an alternate embodiment wheel for the skate structures.
Figure 26:
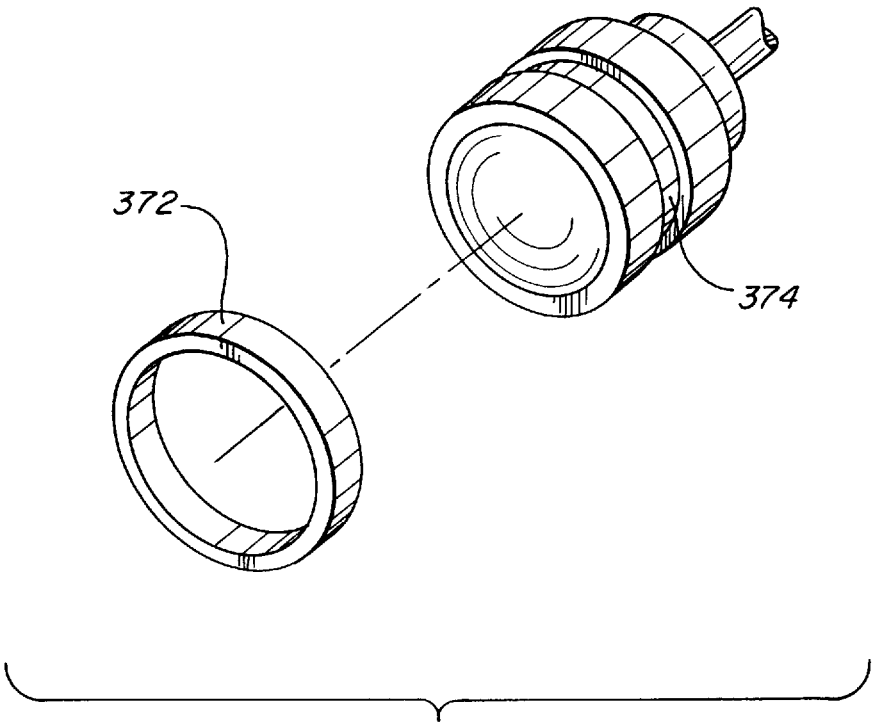
FIG. 26 is an exploded view of the alternate embodiment wheel.

FIGS. 25 and 26 illustrate an alternate wheel embodiment to that shown in the previous drawings. The wheel 370 includes a rubber ring 372 wrapped around the wheel along a channel 374. The rubber ring 372 provides additional friction for use on smooth riding surfaces to ensure that the wheel 370 rotates rather than slides.

Various changes and modifications and equivalents of the embodiments described above and shown in the drawings may be made within the scope of this invention. For example, the axle gear 242 may be modified to a crown gear located on the inside of the wheel 32. As such, the flexible shaft 246 would extend upwardly along the side of the toe cap. Thus, it is intended that all matters contained in the above descriptions or shown in the accompanying drawings are presented by way of example only and are intended to be interpreted in an illustrative and not limiting sense.

I claim:

1. A child's roller skate having a chassis, at least one front wheel attached to the chassis, and a toe cap secured on top of the chassis, comprising:

a movable object secured to the toe cap;

a cam disposed proximal to and rotatable with the wheel;

a cam follower which extends from said cam along the toe cap to an engaging position with said object, such that rotation of said cam resulting in motion of said object.

2. The roller skate as set forth in claim 1, wherein said cam follower is a U-shaped strut.

3. The roller skate as set forth in claim 2, wherein said cam follower has a pair of ribs which engage said object and impart a vertical motion thereon.

* * * * *